US008766538B2

(12) United States Patent
Dinsmore

(10) Patent No.: US 8,766,538 B2
(45) Date of Patent: Jul. 1, 2014

(54) ELECTRICALLY HEATED PLANAR CATHODE

(71) Applicant: Mark T. Dinsmore, Sudbury, MA (US)

(72) Inventor: Mark T. Dinsmore, Sudbury, MA (US)

(73) Assignee: Thermo Scientific Portable Analytical Instruments Inc., Tewksbury, MA (US)

( * ) Notice: Subject to any disclaimer, the term of this patent is extended or adjusted under 35 U.S.C. 154(b) by 0 days.

(21) Appl. No.: 13/946,113

(22) Filed: Jul. 19, 2013

(65) Prior Publication Data

US 2013/0301804 A1 Nov. 14, 2013

Related U.S. Application Data

(63) Continuation of application No. 13/468,886, filed on May 10, 2012, now Pat. No. 8,525,411.

(51) Int. Cl.
*H01J 17/04* (2012.01)

(52) U.S. Cl.
USPC ..... 313/632; 313/631; 313/341

(58) Field of Classification Search
USPC ..... 313/632, 631, 491, 341
See application file for complete search history.

(56) References Cited

U.S. PATENT DOCUMENTS 6,663,982 B1 12/2003 Stephens, Jr.
2005/0062392 A1 3/2005 Sakai et al.

OTHER PUBLICATIONS

Tzeng, Y., et al., "Spiral Hollow Cathode Plasma-Assisted Diamond Deposition," Applied Physics Letters, AIP, American Institute of Physics, Melville, NY, US, vol. 53, No. 23, Dec. 5, 1988, pp. 2326-2327.

*Primary Examiner* — Vip Patel
(74) *Attorney, Agent, or Firm* — Chapin IP Law, LLC

(57) ABSTRACT

An electrically heated planar cathode for use in miniature x-ray tubes may be spiral design laser cut from a thin tantalum alloy ribbon foil (with grain stabilizing features). Bare ribbon is mounted to an aluminum nitride substrate in a manner that is puts the ribbon in minimal tension before it is machined into the spiral pattern. The spiral pattern can be optimized for electrical, thermal, and emission characteristics.

31 Claims, 4 Drawing Sheets

ELECTRICALLY HEATED PLANAR CATHODE

CROSS-REFERENCE TO RELATED APPLICATIONS

This application is a continuation application of prior U.S. patent application Ser. No. 13/468,886 filed May 10, 2012 entitled AN ELECTRICALLY HEATED PLANAR CATHODE.

BACKGROUND

An X-ray tube is a vacuum tube that produces X-rays. The X-ray tube includes a cathode for emitting electrons into the vacuum and anode to collect the electrons. A high voltage power source is connected across the cathode and anode to accelerate the electrons. Some applications require very high-resolution images and require X-ray tubes that can generate very small focal spot sizes.

One type of cathode includes a tungsten filament that is helically wound in a spiral, similar to a light bulb filament. The problem with the wound filament is that the electrons are emitted from surfaces that are not perpendicular to the accelerating electrical fields. This makes it very difficult to focus the electrons into a compact spot on the x-ray target.

SUMMARY

An electrically heated planar cathode for use in miniature x-ray tubes includes a spiral design laser cut from a thin tantalum alloy ribbon foil (with grain stabilizing features). Bare ribbon is brazed to an aluminum nitride substrate in a manner that puts the ribbon in minimal tension before it is machined into a geometric pattern, e.g. a spiral. This prevents distortion of the planar pattern either by the cutting process or through handling and mounting. The spiral pattern can be optimized for electrical and thermal characteristics. The resulting cathode assembly is mounted to a header for mechanical and electrical connection to the rest of the X-ray tube components.

DETAILED DESCRIPTION

An electrically heated planar cathode for use in miniature x-ray tubes includes a spiral design laser cut from a thin tantalum alloy ribbon foil (with grain stabilizing features). Bare ribbon is brazed to an aluminum nitride substrate in a manner that puts the ribbon in minimal tension before it is machined into a geometric pattern, e.g. a spiral. This prevents distortion of the planar pattern either by the cutting process or through handling and mounting. The spiral pattern can be optimized for electrical and thermal characteristics. The resulting cathode assembly is mounted to a header for mechanical and electrical connection to the rest of the X-ray tube components. The remaining tantalum tape outside the cathode spiral forms an equipotential surface that helps form a very collimated and easily focused electron beam.

The particular implementation solves the problem of the fragility of such a structure by mounting the foil to the substrate prior to machining. The use of grain stabilized tantalum is important because of the potential for mechanical distortion due to grain growth that is induced when the cathode is run at operating temperature. This distortion moves the spiral away from the plane of the tantalum ribbon.

Figure 1A:
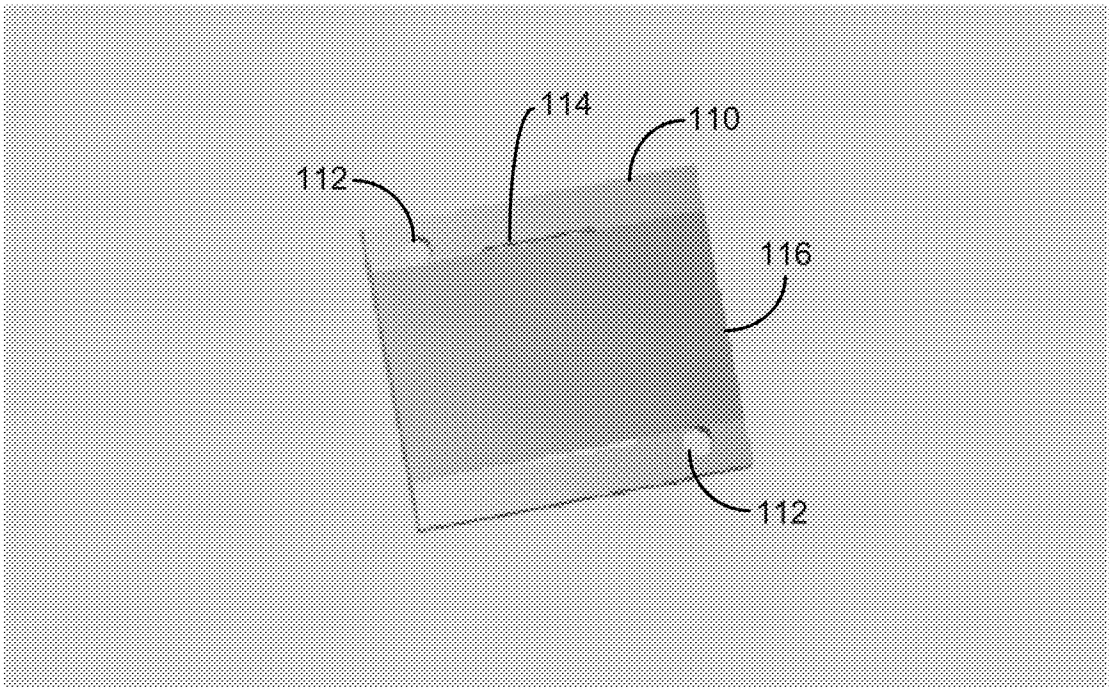
FIG. 1A illustrates a planar cathode structure before cutting.

FIG. 1A illustrates a planar cathode structure before cutting. A substrate 110 includes optional alignment features 112 and a hole 114 (see FIGS. 1A-1C). A tantalum ribbon 116 brazed to an AlN substrate 110 is mounted over the hole 114. There is a slight overlap of the ribbon, e.g. tantalum, with the substrate to allow the substrate to absorb any stray emission currents when in operation. The hole 114 is illustratively shown to be larger than needed.

Figure 1B:
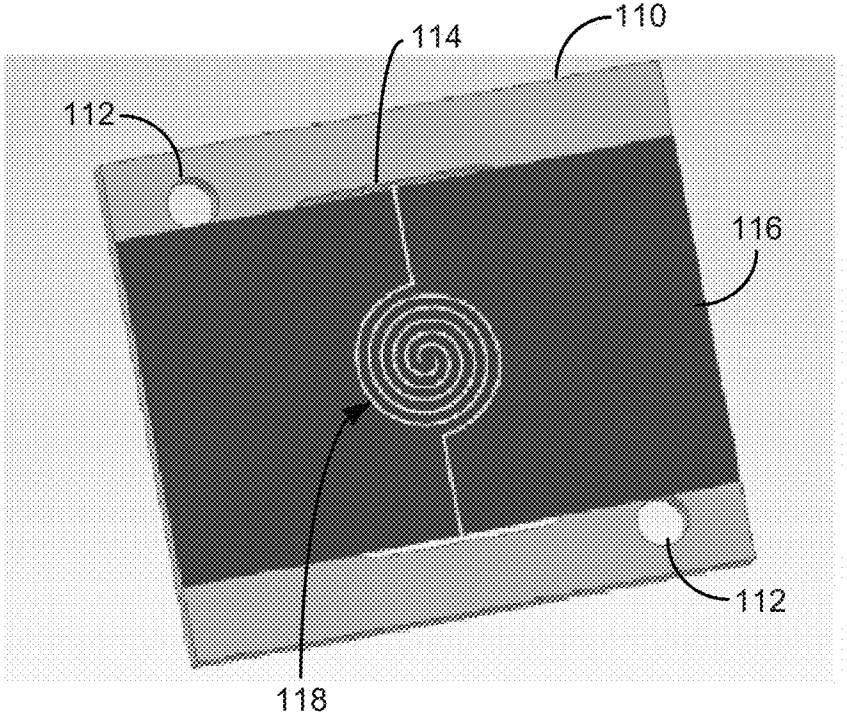
FIG. 1B illustrates a planar cathode structure post laser cutting.

FIG. 1B illustrates a planar cathode structure post laser cutting. A spiral cut 118 has been introduced. The entry and exit of the spiral cut is rounded to minimize sharp corners, thus reducing stray emission currents. In the embodiment, the entry and exit of the spiral cut have been exaggerated to better illustrate minimizing sharp corners.

In this illustrative embodiment, the substrate 110 is made of aluminum nitride (AlN).

While this embodiment illustrates the geometric pattern of the laminate suspended over the opening in the substrate, an opening is optional. There needs to be thermal isolation between the geometric pattern and the substrate. To illustrate, thermal isolation may be achieved by an opening, a cavity, or by suspending the laminate over the substrate such that there is an air gap.

Figure 1C:
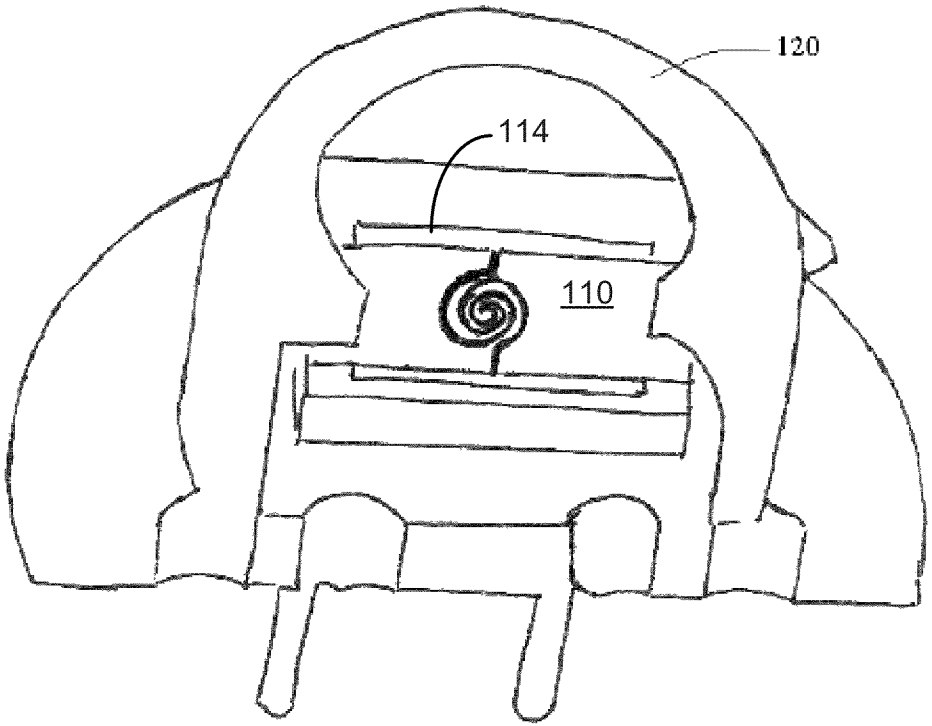
FIG. 1C illustrates a packaged planar cathode structure.

FIG. 1C illustrates the planar cathode mounted in a typical header and lens assembly 120.

Figure 2:
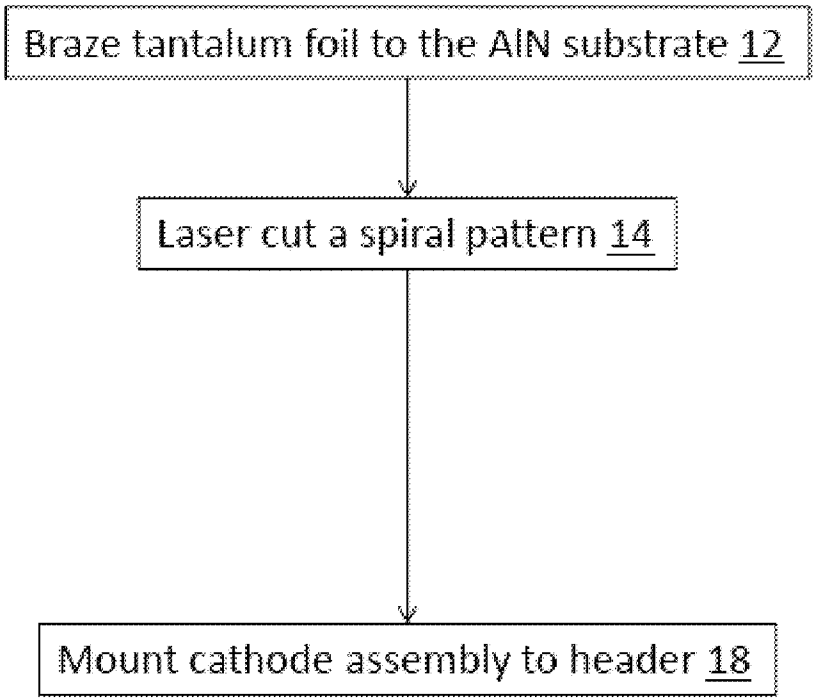
FIG. 2 is a process flow chart for the planar cathode shown in FIG. 1A and FIG. 1B.

FIG. 2 is a process flow chart for the planar cathode shown in FIG. 1A and FIG. 1B. In step 12, tantalum foil is brazed to an AlN substrate. The brazing may be accomplished by a foil using an active braze material to an AlN substrate to generate a laminate or metalizing the substrate and using conventional brazing processes to generate the laminate. In step 14, a spiral pattern is laser cut or etched. The subsequent cathode may be handled without damaging the spiral pattern due to the substrate. Optional alignment features are added during the manufacture of the substrate, as machining them after brazing or cutting would endanger the spiral. In the process, the alignment features are used to calibrate position before cutting the spiral, so that the spiral is centered between the alignment features. In step 18, the cathode assembly is mounted to the header via the alignment features to provide the electrical connections and to mechanically align the cathode with the rest of the electron optical components.

In the illustrative example, the tantalum ribbon was brazed to AlN substrate because they had similar thermal coefficients of expansion. When the cathode is cut out, it remains planar.

The concept may be extended to other materials that do not evaporate or distort over time. Foil materials include, but are not limited to, tungsten rhenium, thoriated tungsten, tungsten alloys, hafnium, and other tantalum based materials, exhibiting an electron work function less than 6 eV. Coatings can be added to the spiral to reduce the work function of the spiral, thus permitting use of different spiral materials and reducing the temperature and power needed to produce adequate electron flux.

I claim:

1. A planar cathode, comprising:

a first substrate; and a laminate of a foil and a second substrate, the foil and the second substrate having matching thermal coefficients of expansion, the laminate being mounted on the first substrate, wherein the foil is shaped into a predetermined geometric pattern, the foil having performance parameters that are selected from a group including area, voltage, current, power, and electron emission; and wherein there is thermal isolation between the geometric pattern and the first or second substrate.

2. A planar cathode, as in claim 1, the first substrate further including alignment features, wherein the alignment features are selected from a group including holes, mechanical features, and optical features.

3. A planar cathode, as in claim 2, wherein the alignment features provide an electrical connection to other components.

4. A planar cathode, as in claim 1, wherein the laminate of the foil and the second substrate is tantalum foil brazed to an AlN substrate.

5. A planar cathode, as in claim 1, wherein the predetermined geometric pattern is a spiral cut on the foil.

6. A planar cathode, as in claim 5, the spiral cut including a rounded entry and a rounded exit.

7. A planar cathode, as in claim 1, wherein the foil is selected from a group including tungsten rhenium, thoriated tungsten, tungsten alloys, hafnium, and tantalum based materials having a work function less than 6 eV.

8. A planar cathode, as in claim 1, wherein the foil is coated to exhibit an electron work function less than 6 eV.

9. A planar cathode, as in claim 1, wherein the laminate is suspended over the first substrate.

10. A planar cathode, as in claim 1, wherein the foil comprises a grain stabilized foil.

11. A planar cathode, as in claim 1, wherein the foil comprises a grain stabilized tantalum foil.

12. A method of making a planar cathode, comprising:

attaching a grain stabilized foil to a substrate to generate a laminate;

shaping the grain stabilized foil in the laminate into a predetermined geometric pattern; and mounting the laminate on a header.

13. A method, as in claim 12, wherein the predetermined geometric pattern is a spiral.

14. A method, as in claim 13, wherein the spiral includes a rounded entry and a rounded exit.

15. A method, as in claim 12, wherein the grain stabilized foil is selected from a group including tungsten rhenium, thoriated tungsten, tungsten alloys, and other refractory based thermionic emission materials, or cathodes made with a low work function emission coating.

16. A method, as in claim 12, wherein the grain stabilized foil is selected from a group including tungsten rhenium, thoriated tungsten, tungsten alloys, hafnium, and tantalum based materials having a work function less than 6 eV.

17. A method, as in claim 12, including coating the grain stabilized foil to exhibit an electron work function less than 6 eV.

18. A method, as in claim 12, wherein the shaping of the grain stabilized foil in the laminate includes laser cutting the grain stabilized foil to form the predetermined geometric pattern in the laminate.

19. A method, as in claim 12, wherein the shaping of the grain stabilized foil in the laminate includes etching the grain stabilized foil to form the predetermined geometric pattern in the laminate.

20. A method, as in claim 12, wherein the attaching of the grain stabilized foil to the substrate includes brazing the grain stabilized foil to the substrate to generate the laminate.

21. A method, as in claim 12, wherein the grain stabilized foil comprises a grain stabilized tantalum foil.

22. A method, as in claim 12, including adding alignment features to the substrate before shaping the grain stabilized foil in the laminate into the predetermined geometric pattern.

23. A method, as in claim 22, including calibrating a position of the predetermined geometric pattern in the laminate using the alignment features.

24. A method, as in claim 23, wherein the position of the predetermined geometric pattern in the laminate is centered between the alignment features.

25. A method, as in claim 22, wherein the mounting of the laminate on the header includes mounting the laminate on the header via the alignment features.

26. A method, as in claim 22, wherein the mounting of the laminate on the header includes mounting the laminate on the header via the alignment features to provide an electrical connection to other components.

27. A method, as in claim 26, wherein the mounting of the laminate on the header includes mounting the laminate on the header via the alignment features to mechanically align the planar cathode with the other components.

28. A method, as in claim 12, wherein the substrate is an AlN substrate.

29. A planar cathode, comprising:

a first substrate; and a laminate of a foil and a second substrate, the foil and the second substrate having matching thermal coefficients of expansion, the laminate being mounted on the first substrate, wherein the foil is shaped into a predetermined geometric pattern; and wherein there is thermal isolation between the geometric pattern and the first or second substrate.

30. A planar cathode, as in claim 29, wherein the foil comprises a grain stabilized foil.

31. A planar cathode, as in claim 29, wherein the foil comprises a grain stabilized tantalum foil.

* * * * *